United States Patent [19]

Barrett

[11] Patent Number: 4,836,079

[45] Date of Patent: Jun. 6, 1989

[54] BOMB BLAST INHIBITOR AND METHOD OF BOMB BLAST INHIBITION

[75] Inventor: Garth J. M. Barrett, Northcliff, South Africa

[73] Assignee: Cube Overseas Trading Ltd, Channel Islands

[21] Appl. No.: 141,849

[22] Filed: Jan. 11, 1988

[30] Foreign Application Priority Data

Jan. 14, 1987 [ZA] South Africa ..... 87/0235

[51] Int. Cl.[4] ..... F42B 33/00; C06B 21/00

[52] U.S. Cl. ..... 86/50; 102/303; 109/26; 428/911; 86/1.1; 220/89 R; 220/89 A

[58] Field of Search ..... 86/49, 50; 102/303; 89/36.02, 36.04, 36.07; 109/26, 49.5, 1 R; 220/444, 468, DIG. 9, 89 R, 89 A, 900, 902; 428/911

[56] References Cited

U.S. PATENT DOCUMENTS

| | | | |
|---|---|---|---|
| 232,640 | 9/1880 | Hallock | 102/303 |
| 3,739,731 | 6/1973 | Tabor | 86/50 |
| 4,432,285 | 2/1984 | Boyars et al. | 86/50 |
| 4,478,126 | 10/1984 | Holmlund et al. | 86/50 |
| 4,543,872 | 10/1985 | Graham et al. | 86/50 |
| 4,589,341 | 5/1986 | Clark et al. | 102/303 |
| 4,621,559 | 11/1986 | Ohlson | 86/50 |
| 4,727,789 | 3/1988 | Katsanis et al. | 86/50 |

FOREIGN PATENT DOCUMENTS

| | | |
|---|---|---|
| 2295399 | 12/1975 | France . |
| 670626 | 4/1952 | United Kingdom . |
| 754155 | 8/1956 | United Kingdom . |
| 992443 | 5/1965 | United Kingdom . |
| 1001872 | 8/1965 | United Kingdom . |
| 1009853 | 11/1965 | United Kingdom . |
| 1078272 | 8/1967 | United Kingdom . |
| 1218806 | 1/1971 | United Kingdom . |
| 1246102 | 9/1971 | United Kingdom . |
| 1300634 | 12/1972 | United Kingdom . |
| 1322199 | 7/1973 | United Kingdom . |
| 1536555 | 12/1978 | United Kingdom . |

OTHER PUBLICATIONS

European Search Report.

Translation of the Official Letter-Our Comments: Official Action and comments of Taiwanese Appln.

*Primary Examiner*—Howard J. Locker

*Attorney, Agent, or Firm*—Stevens, Davis, Miller & Mosher

[57] ABSTRACT

A method and inhibitor are provided for substantially diminishing the deleterious effects of a bomb blast such as is commonplace with terrorist activities. A generally flexible container filled with a liquid, generally water, is shaped and adapted to substantially cover a bomb to obscure substantially all open spaces from the bomb. The water serves to absorb a large proportion of the energy of the bomb blast and therefore reduces the most dangerous effects of bombs namely that of secondary shrapnel which generally does the most damage and the container and water prevent, to a substantial extent, any primary shrapnel or other debris from being blown out with substantial force. The invention also provides special containers of various different designs as well as a method of manufacturing such containers which are preferably of a resilient nature.

17 Claims, 4 Drawing Sheets

BOMB BLAST INHIBITOR AND METHOD OF BOMB BLAST INHIBITION

FIELD OF THE INVENTION

This invention relates to a bomb blast inhibitor particularly adapted to be used for decreasing the deleterious effects of a bomb blast and, accordingly, decreasing the likelihood of injury to persons in the vicinity as well as decreasing the damage caused to property by a bomb blast. The invention also relates to a method of inhibiting bomb blasts using an inhibitor provided by the invention.

In this specification it is to be understood that the term "bomb" is used in a broad sense and includes hand grenades, limpet mines and any other types of bomb which can be detonated by a timing device, a remote control device or by any other initiator.

BACKGROUND TO THE INVENTION

Bombs of one form or another are increasingly being used by terrorists, alleged freedom fighters, as well as other persons to cause destruction of property and loss of life such as in urban or other terrorist activities. Often bombs are discovered in abandoned suitcases, briefcases or the like or hand granades can be hurled at different targets. Such bombs can sometimes be defused but often this is not possible in the time available.

It is the object of this invention to provide a bomb blast inhibitor, and a method of using such an inhibitor, whereby the devastating effects of a bomb blast can be substantially decreased both insofar as the effect on persons and property is concerned.

It is to be understood that the term "liquid" as used herein is intended to include any suitable non-inflammable liquid or semi-liquid such as suitable gels. Generally the "liquid" will include at least a substantial proportion of water.

SUMMARY OF THE INVENTION

In accordance with one aspect of this invention there is provided a method of diminishing the deleterious effects of a bomb blast comprising locating a container filled with liquid (as herein defined) relative to a bomb to substantially cover same and substantially obscure the bomb from the surrounding open spaces.

Further features of the invention provide for the liquid to be water or an aqueous solution; for the container to be flexible and to be "inflated" with said liquid, the container preferably being made of resilient material; for the container to be firstly erected by inflating it with air and thereafter displacing the air with said liquid; and for the container to be maintained substantially out of physical contact with the bomb, at least in certain selected cases.

The invention also provides a bomb blast inhibitor comprising a closed, frangible container, operative by virtue of its shape and/or physical properties, to substantially cover a predetermined size of bomb when it is filled with a liquid such that liquid is present between substantially all surrounding open spaces and such bomb, in use.

Further features of this aspect of the invention provide for the container to be flexible, preferably of resilient material; for the container to be made of cut sheets of flexible material joined together along seams to define the closed container; for the cut sheets of flexible material to be initially uncured or partially cured rubber material stacked together with interposed release sheets or layers therebetween covering areas not to be secured together and wherein the entire stack of sheets is then cured to secure the sheets together in areas not covered by the release sheets; and for the container to be formed into a plurality of generally interconnected compartments.

Still futher features of the invention provide for the container to comprise a first and operatively upper compartment forming a top to the inhibitor and a second and lower compartment extending around at least a part of the periphery of the upper compartment to form a sidewall for tee inhibitor; for a plurality of compartments to be arranged in a vertically stacked relationship to define a sidewall of the inhibitor; for the compartments to be interconnected; and for an inlet valve for liquid to be provided in an operatively lower region of the container and an outlet, generally in the form of a relief valve, in an operatively upper region.

It is an important feature of the invention, although not entirely a neccessity, that the containers be provided with handles for manipulating same, particularly in the case where relatively small size containers are provided for the smaller range of bombs such as hand grenades and limpet mines. Such smaller range of inhibitors are generally permanently inflated with liquid and sealed in a closed condition so that they are permanently ready for use. Such filling can conveniently be achieved using a tubular needle passed through a flexible container wall with the resultant hole being sealed off after the predetermined quantity of liquid has been introduced into the container.

The invention still further provides a method of manufacturing a bomb blast inhibitor substantially as described hereunder.

Various different embodiments of the invention will now be described with reference to the accompanying drawings in order that the invention made more fully understood.

DETAILED DESCRIPTION WITH REFERENCE TO THE DRAWINGS

Figure 1:
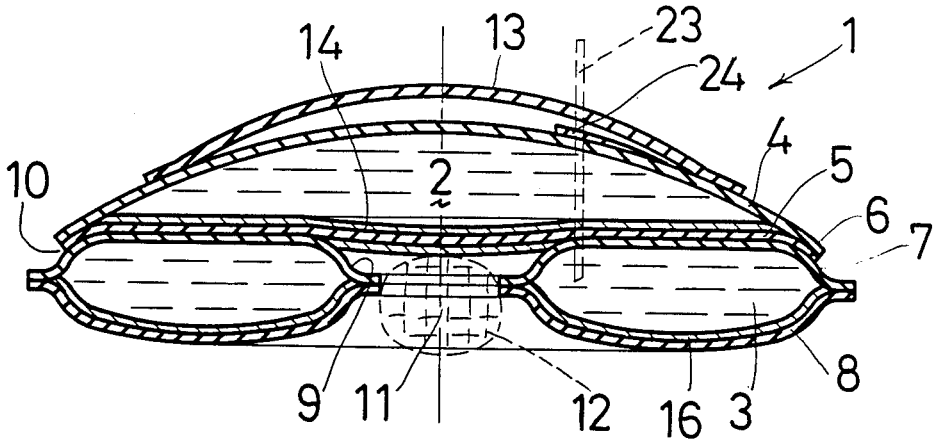
FIG. 1—is a sectional elevation of a bomb blast inhibitor particularly adapted for use on hand granades.
Figure 2:
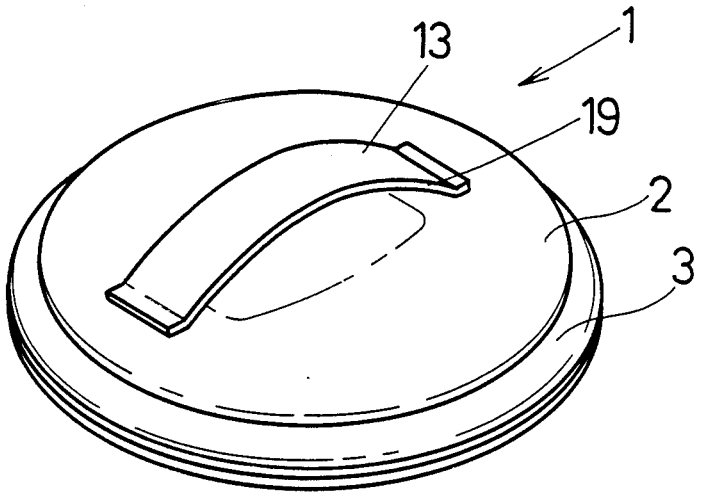
FIG. 2—is an isometric top view of the inhibitor illustrated in FIG. 1.
Figure 3:
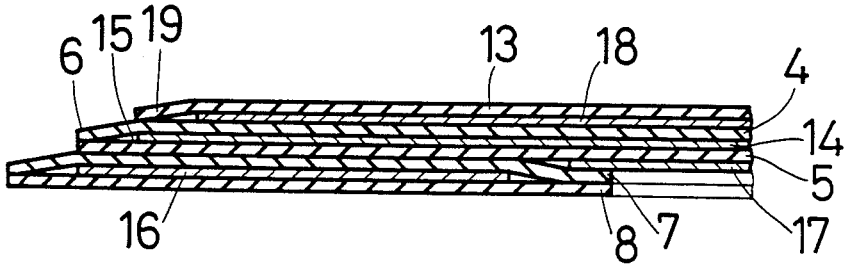
FIG. 3—is a section taken through one side of the inhibitor illustrated in FIG. 1 with the inhibitor in the collapsed condition and illustrating the manufacture thereof.

Referring firstly to FIGS. 1 to 3, there is illustrated a bomb blast inhibitor particularly adapted for use in diminishing the deleterious effects of the blast of a hand grenade. In this case, the bomb blast inhibitor, generally indicated by the numeral 1, comprises an upper compartment 2, forming a lid or top to the inhibitor and conveniently being of circular shape, and a lower compartment 3, of annular shape extending around the circumference of the lid and permanently secured thereto.

Each of the upper and lower compartments are defined by sheets of elastomeric material, in particular butyl rubber, the sheets being secured together along seams to define the compartments.

Thus, the upper compartment is defined by an upper rubber sheet 4 and a lower rubber sheet 5, secured together at a seam around the periphery 6 thereof.

The lower compartment 3 is similarly formed by an upper sheet 7 of rubber material and a lower sheet 8, in this case the sheets being of annular shape secured together at their inner and outer peripheries. The upper sheet 7 of the lower compartment and the lower sheet 5 of the upper compartment are also secured together over a substantial proportion of the juxtaposed surfaces but not at the inner region 9. The outer regions 10 of such juxtaposed surfaces are, however, secured together. The reason for the former is to enable the lower compartment to inflate adequately in an axial direction so that the space 11 in the centre of the inhibitor can accomodate a hand grenade 12 therein.

The top is also provided with a handle 13 made of nylonly enforced butyl rubber whereby the inhibitor can be manipulated.

It has been found that the size of the inhibitor should be made such of that it can accomodate approximately 4,0 kilograms of water.

The above described bomb blast inhibitor is made by stacking the sheets of material together, as shown more clearly in FIG. 3, as well as the handle, but with release sheets interposed between the sheets of partly or fully uncured rubber in areas where the sheets are not to be secured to each other.

Thus, a first release release sheet 14, of circular shape, is introduced between the sheets 4 and 5 forming the upper compartment the release sheet terminating short of the periphery, as indicated by numeral 15, so that the peripheral seam 6 can be formed between the two butyl rubber sheets 4 and 5. Similarly, a release sheet 16 is introduced between the sheets 7 and 8 forming the lower compartment, this release sheet being of annular shape. A further release sheet 17 is employed in the region 9 where the periphery of the second compartment is not to be secured to the undersurface of the upper compartment 2.

Instead of a release sheet to prevent the handle 13 from becoming adhered to the top sheet 4 of the upper compartment, a stainless steel plate 18 is positioned between the handle and the top sheet 4, the stainless steel plate allowing only the ends 19 of the handle to contact the said top sheet 4. Materials other than stainless steel could also be used for this purpose.

Figure 8:
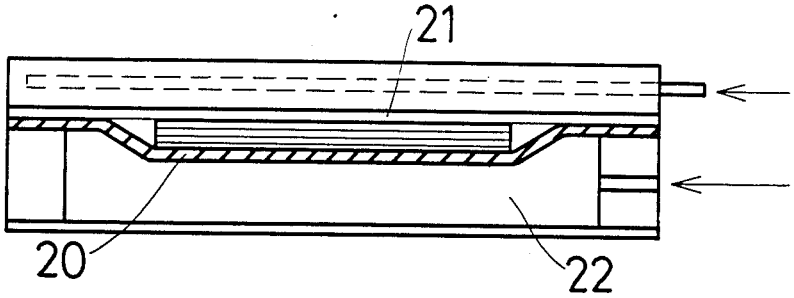
FIG. 8—is a schematic cross-sectional elevation of apparatus illustrating the method of manufacture of an inhibitor.

The above described stack of sheets is positioned between a flexible diaphragm 20 (see FIG. 8) and a rigid, heated, mould plate 21, the diaphragm being urged towards the mould plate 21 by virtue of compressed air introduced into a chamber 22 formed on the said of the diaphragm 20 remote from the mould plate 21. This arrangement enables the varying thickness of the stack of sheets of material to be accomodated and all the required uniting of the sheets of material together along seams or the like to take place as the rubber is cured or fully cured. After curing has taken place the stainless steel plate is removed to free the handle over the major portion of its length.

In order to fill the above described inhibitor a tubular needle 23 (see FIG. 1) is simply passed through the appropriate sheets of rubber material such that the lower compartment is firstly filled with water and the needle is thereafter withdrawn a short distance and the upper compartment is then filled by passing water through the needle.

Conveniently the needle is introduced beneath the handle and a hot rubber patch 24 is employed to permanently seal the hole made by the needle. Thus, the above described bomb blast inhibitor is permanently inflated and ready for immediate use at all times.

It has been found that a bomb blast inhibitor of the above described type, and which is made to accomodate 4,0 kilograms of water, is adequate to reduce the deleterious effects of a hand grenade blast, of the most severe type of which applicant is aware, by 85 per cent.

Figure 4:
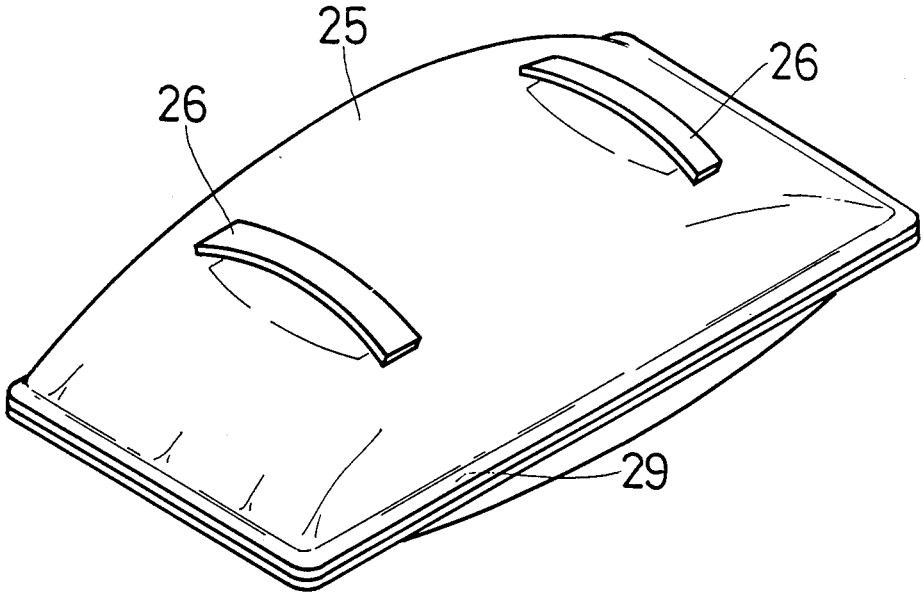
FIG. 4—is an isometric view of a second embodiment of the invention for use on somewhat larger bombs.
Figure 5:
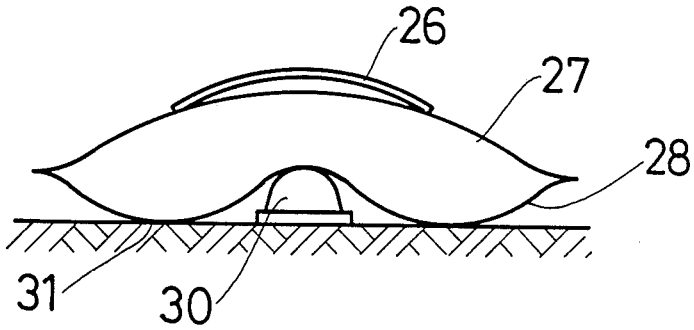
FIG. 5—is a cross-section taken through the inhibitor of FIG. 4 and showing a bomb covered thereby.

FIGS. 4 and 5 illustrate a somewhat simple embodiment of the invention in which a rectangular single compartment bomb blast inhibitor 25 having two handles 26 secured to the operatively upper surface thereof, is made of similar rubber material to that described above and in a similar manner, only two sheets of rubber 27 and 28 being required. Again a release sheet (not shown) is introduced over the major portion of tee area of the sheets so that they are only secured together during curing, at their peripheries 29.

As shown in FIG. 5, this embodiment of the invention is adapted simply to deform to accomodate a smallish bomb, such as a limpet mine 30 with the container surrounding the bomb being in contact with the ground as indicated by numeral 31. This bomb blast inhibitor is filled in the same way as is described above and is adapted to receive approximately 15 kilograms of water. This bomb blast inhibitor is also adapted to be permanently "inflated".

An alternative form of inhibitor for such limpet mines and, in fact, for "pipe bombs" is one in which such a simple rectangular container is provided with a peripherally extending second chamber defining a surrounding "sidewall" as in the use of the first described invention. The resultant inhibitor is simply a rectangular and larger version of the embodiment of FIGS. 1 to 3.

Figure 6:
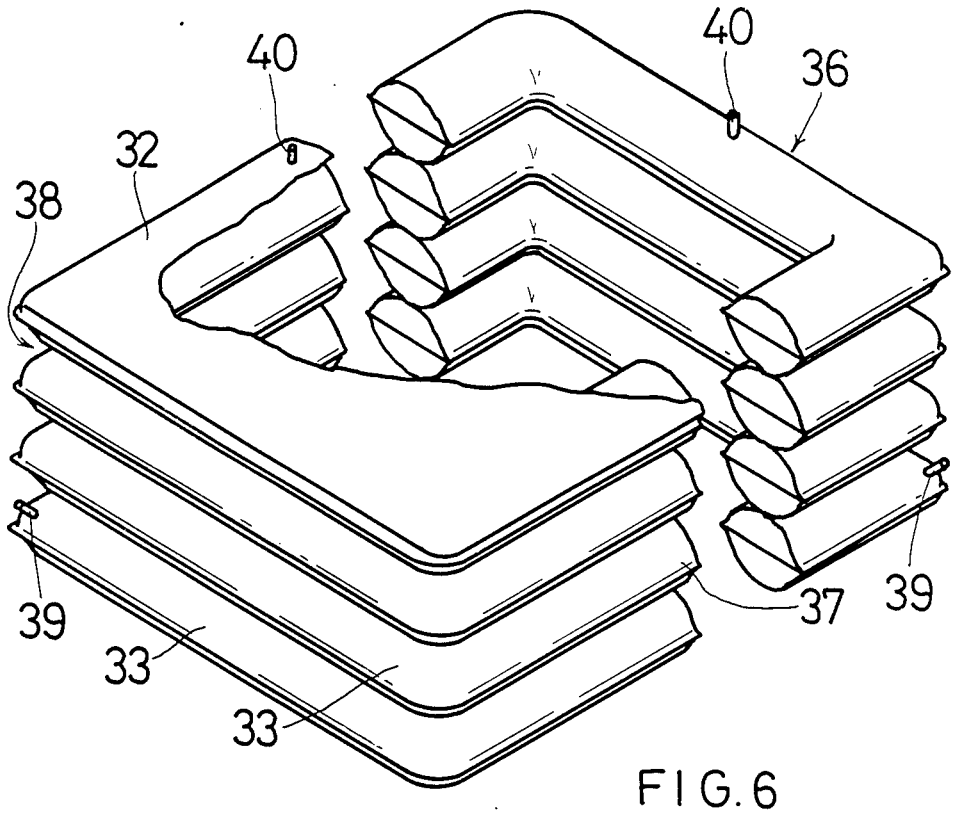
FIG. 6—is an isometric illustration of a very much larger bomb blast inhibitor according to the invention for use on relatively large bombs.
Figure 7:
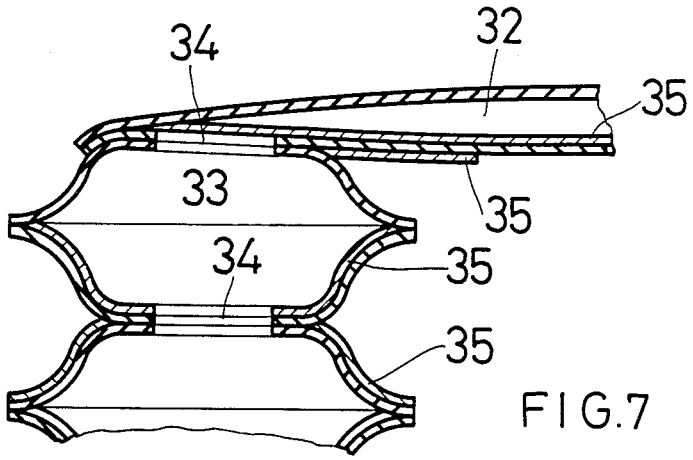
FIG. 7 illustrates in cross-section the upper portion of a section of the wall of the inhibitor illustrated in FIG. 6.

Referring now to FIGS. 6 and 7, there is illustrated a bomb blast inhibitor according to this invention which is designed for use on substantially larger bombs. In this case the inhibitor would be too cumbersome to be fully "inflated" with water and, accordingly, is generally stored in an uninflated condition.

The bomb blast inhibitor in this case has a top 32, once more formed of two sheets of rubber material secured together at the periphery, and the top is, in this case, supported by a series of vertically stacked chambers 33 which are interconnected by holes 34 both with each other and with the top.

The assembly and manufacture is conducted in the same way using release sheets 35 in zones which are not to be secured together and thus forming the series of tubular chambers 33 supporting the top 32.

The shape of this bomb blast inhibitor is a U-shape in plan view so that a bomb, for example situated against the wall, can be substantially enclosed with the wall forming the one side of the enclosure. However, as a separate unit 36, there is provided a fourth wall to complete the rectangle, the unit 36 having a very shallow U-shape in plan view to co-operate with the free-end 37 of the sidewall of the main unit 38.

Both of these units have inlet valves 39 at the bottom thereof and outlet relief valves 40 at the top.

In order to erect an inhibitor of this type air is firstly introduced through the inlets 39 to inflate the inhibitor and, once inflated, water is then introduced through the inlets 39 at a substantially higher presure. This causes displaced air to escape through the outlet relief valves 40 as the inhibitor fills with water.

In the case of the outlet relief valve 40 of the main unit 38, his valve can be made to be manually openable if it is desired that the top 32 be deflated, for example to enable a demolition expert to gain access to a bomb covered by the inhibitor. When using this embodiment of the invention the second unit 36 could, where a bomb is located against a wall, be positioned on the opposite side of the wall to assist in reducing the deleterious effects of an explosion.

Figure 9:
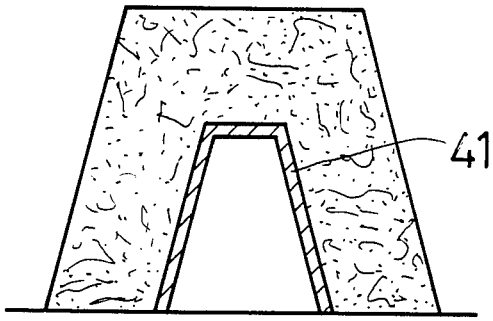
FIG. 9—illustrates in schematic sectional elevation a still further embodiment of the invention.

It will be understood that numerous other embodiments of the invention are possible within the scope hereof, the above simply being illustrative. Simply by way of example, as illustrated in FIG. 9, where it is required to maintain a flexible container out of contact with a bomb, a rigid liner 41 could be provided on the inside of the flexible container which, in this case, is shaped to a truncated conical shape.

Figure 10:
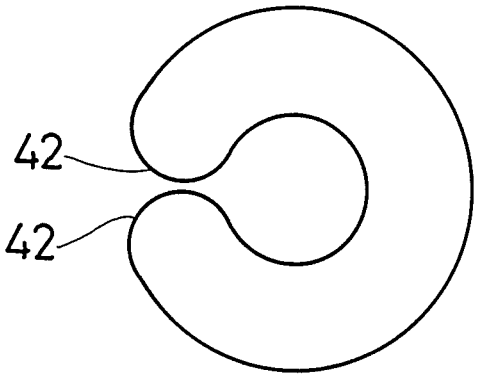
FIG. 10—illustrates in plan view an alternative shape to the inhibitor of FIGS. 6 and 7.

Also, by virtue of the flexible nature of the containers, it is possible to make a container of an annular shape in plan view as illustrated in FIG. 10 where the annulus is incomplete and has two ends 42, which can simply be moved apart to operatively install the inhibitor relative to a bomb.

It has been found, in use, that upwards of 85 percent of the deleterious effects of a bomb blast are dissipated by the use of a correct amount of liquid, in particular water. The shock wave and "fire-ball" generally associated with the explosion of a bomb has been observed not to develop when an appropriate size of inhibitor according to this invention is employed.

Other variations clearly include the use of different materials of manufacture, different methods of manufacture as well as different shapes and sizes of containers. Also, the containers could be rigid, flexible but not resilient or any combination thereof.

What I claim as new and desire to secure by Letters Patent is:

1. A method of diminishing the deleterious effects of a bomb blast comprising locating a closed, frangible container of a size and shape to cover said bomb when filled with non-flammable liquid said container being formed with a plurality of closed compartments for said liquid with a first compartment forming a closed top of the inhibitor and a second compartment thereunder extending around at least a part of the periphery of the upper compartment and forming a supporting sidewall of said container;

each of said compartments being made of a sheet material joined together at seams to define the closed container, said container being located relative to a bomb so as to substantially cover same and substantially obscure the bomb from all surrounding open spaces.

2. A method as claimed in claim 1 in which the container is a flexible container "inflated" with said liquid.

3. A method as claimed in claim 2 in which the flexible container is made of resilient material.

4. A method as claimed in claim 2 in which the container is firstly erected by inflating it with air and thereafter the air is displayed by said liquid by way of an outlet valve.

5. A method as claimed in claim 1 in which the container is maintained out of physical contact with the bomb.

6. A bomb blast inhibitor comprising a closed, frangible container operative, by virtue of its shape and/or physical properties to substantially cover a predetermined size of bomb when filled with a on-flammable liquid such that liquid is present between substantially all surrounding open spaces and a bomb when the inhibitor is in place to substantially cover the bomb;

said container being formed with a plurality of closed compartments for said liquid with a first compartment forming a closed top of the inhibitor and a second compartment thereunder extending around at least a part of the periphery of the upper compartment and forming a supporting sidewall of said container;

each of said compartments being made of a sheet material joined together a seams to define the closed container.

7. A bomb blast inhibitor as claimed in claim 6 in which the container is made of a flexible material.

8. A bomb blast inhibitor as claimed in claim 7 in which the container is made of cut sheets of flexible material joined together along seams to define the closed container.

9. A bomb blast inhibitor as claimed in claim 8 in which the cut sheets of flexible material are an initially uncured or partially uncured rubber material stacked together with release sheets or layers therebetween in areas not to be secured together and the stack of sheets is then cured to secure the sheets together in areas not covered by the release sheets or layers.

10. A bomb blast inhibitor as claimed in claim 6 in which the container is formed into a plurality of compartments for said liquid.

11. A bomb blast inhibitor as claimed in claim 6 in which the second compartment is supported operatively on a third and still lower compartment to define a sidewall in the form of a plurality of vertically stacked compartments.

12. A bomb blast inhibitor as claimed in claim 6 in which an inlet valve for air and liquid is provided in said second compartment of the container and an outlet in said first compartment.

13. A bomb blast inhibitor as claimed in claim 6 and having one or more handles thereon for manipulating same.

14. A bomb blast inhibitor as claimed in claim 13 and comprising a container of sufficiently flexible material to enable it to deform to accommodate a predetermined maximum size of bomb when placed thereover.

15. A bomb blast inhibitor as claimed in claim 6 wherein the container is permanently filled with a predetermined charge of liquid and is sealed closed.

16. A bomb blast inhibitor as claimed in claim 15 in which a tubular needle is passed through the container wall to introduce the liquid and the resultant hold is sealed off after introduction of the liquid is complete.

17. A bomb blast inhibitor comprising a closed, frangible container of a size shape to cover a predetermined size of bomb when said container is filled with a non-flammable liquid;

said container being formed with a plurality of closed compartments for said liquid with a first compartment forming a closed top of the inhibitor and a second compartment thereunder extending around at least a part of the periphery of the upper compartment and forming a supporting sidewall of said container;

each of said compartments being made of a sheet material joined together at seams to define the closed container.

* * * * *